United States Patent [19]

Heniff, Jr.

[11] 4,200,949

[45] May 6, 1980

[54] CONTAINER FOR STORING PAINT AND A ROLLER-TYPE PAINT APPLICATOR

[76] Inventor: William V. Heniff, Jr., 12632 S. Harold St., Palos Heights, Ill. 60463

[21] Appl. No.: 947,496

[22] Filed: Oct. 2, 1978

[51] Int. Cl.[2] ..... A47L 13/56; B08B 3/00

[52] U.S. Cl. ..... 15/257.06; 134/135

[58] Field of Search ..... 15/104.92, 38, 257.05, 15/257.06, 248 A, 261; 68/213; 134/135; 206/15.2, 15.3; 220/90; 248/110, 112, 113; 401/120–122, 127, 118

[56] References Cited

U.S. PATENT DOCUMENTS

| | | | |
|---|---|---|---|
| 63,841 | 4/1867 | Bly | 401/122 |
| 252,603 | 1/1882 | Kennish | 401/122 |
| 860,838 | 7/1907 | Spingler | 15/257.06 |
| 1,286,783 | 12/1918 | Ritz | 401/127 |
| 1,838,490 | 12/1931 | Lerum | 15/257.05 |
| 2,646,808 | 7/1953 | Yenne | 15/104.92 |
| 2,932,838 | 4/1960 | Ouellette | 15/257.06 |
| 2,945,251 | 7/1960 | Eichner | 15/104.92 |
| 2,965,111 | 12/1960 | Feigelman | 134/135 |

*Primary Examiner*—Edward J. McCarthy
*Attorney, Agent, or Firm*—Merriam, Marshall & Bicknell

[57] ABSTRACT

A container for storing a quantity of paint and a roller-type paint applicator wherein a pair of plate-like members are mounted in vertically extending, spaced relation in the receptacle portion of the container by a pair of elongated, laterally spaced mounting members which extend horizontally through openings in the side walls of the container and upper ends of the plate-like members. A plurality of coil springs interconnect the plate-like members and bias the plate-like members toward each other with sufficient force, when engaged with the roller of the applicator, to support the roller in an elevated position above the level of paint in the receptacle portion when the applicator is not in use. The plate-like members also wipe excess paint from the roller as the latter is shifted upwardly between the members after being immersed in paint. A portion of the frame of the applicator extends through an opening in the cover of the container. The cover also serves to support the applicator in an upright position in the container when the applicator is not in use.

11 Claims, 8 Drawing Figures

CONTAINER FOR STORING PAINT AND A ROLLER-TYPE PAINT APPLICATOR

This invention relates to paint containers, and more particularly relates to a container for storing a quantity of paint and a roller-type paint applicator when the latter is not in use and for wiping excess paint from the roller when the applicator is in use.

Paint containers have been developed for use with roller-type applicators, which serve the dual purpose of acting as a reservoir for a quantity of paint and which include a roughened surface for setting paint in the nap of the roller of the applicator. An example of one such type of paint container is disclosed in the U.S. Pat. No. 2,763,880, by Mulcahy.

Devices have also been developed for wiping excess paint from the roller of a roller-type applicator when the latter is in use. One such devise is inserted into a partially filled paint container and provides an inclined surface over which the roller of the applicator is rolled after immersion in the paint so that excess paint is removed from the roller. An example of the latter type of device is disclosed in the U.S. Pat. No. 2,705,334, by Farrow.

While the aforementioned devices have proved generally satisfactory for their intended purposes, so far as is known, no device has been developed which serves as a reservoir or vessel for a quantity of paint, acts as a storage container for a roller-type paint applicator when the latter is not in use, and wipes excess paint from the roller of the applicator each time the applicator is withdrawn from the container for a painting operation.

Accordingly, it is the general object of the present invention to provide a novel container for a roller-type paint applicator, which achieves the above-mentioned advantages over the prior art.

Another object is to provide a novel container for receiving a quantity of paint and for storing a roller-type paint applicator therein so that the applicator is at all times ready for use.

A further object is to provide a novel container of the foregoing character, which serves to wipe excess paint from the roller of the applicator each time the applicator is withdrawn from the container for a painting operation.

Still another object is to provide a novel combination paint and roller-type paint applicator storage container of the character described, which is simple in construction, reliable in operation and economical to manufacture.

These and other objects will be apparent from the following detailed description and accompanying sheets of drawings, in which.

Figure 6:
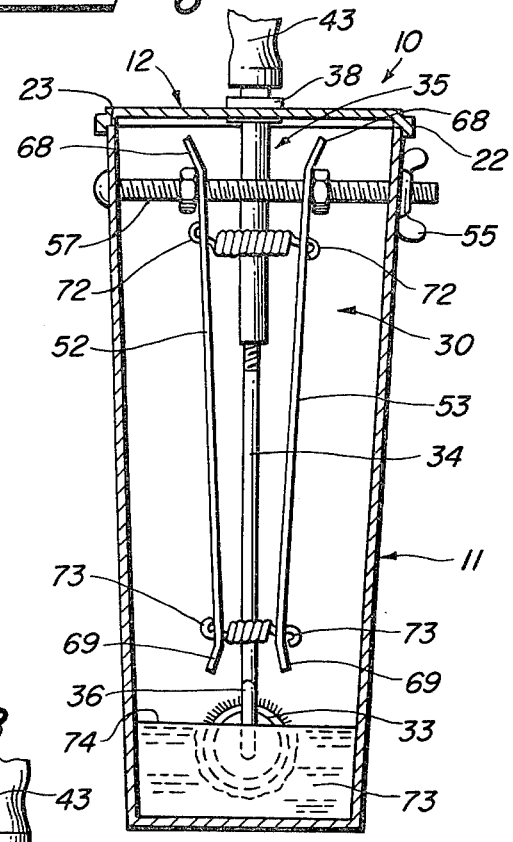
FIG. 6 is a longitudinal sectional view, similar to FIG. 4, but showing the roller of a roller-type paint applicator partially immersed in paint in the lower portion of the container.
Figure 7:
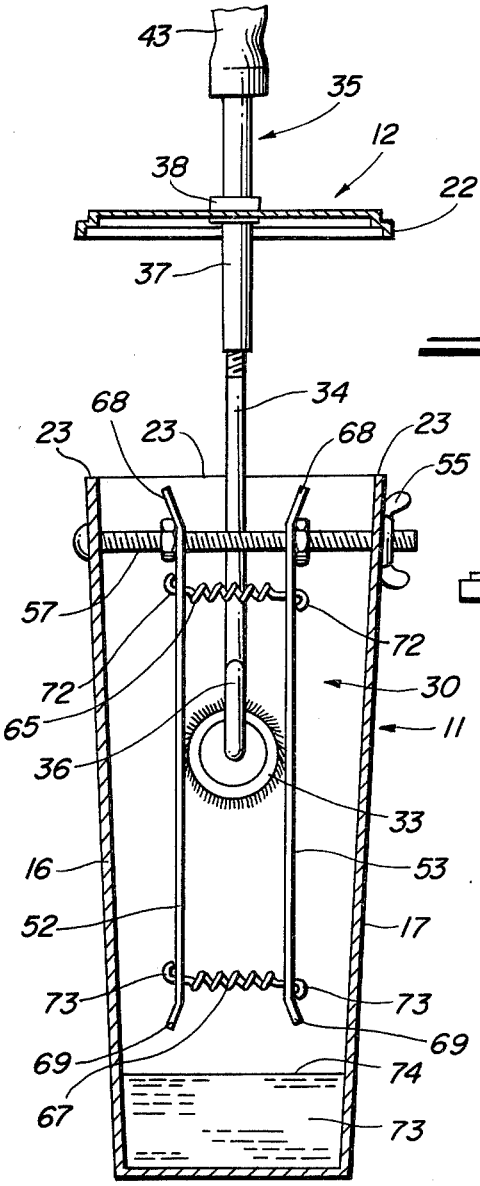
Figure 8:
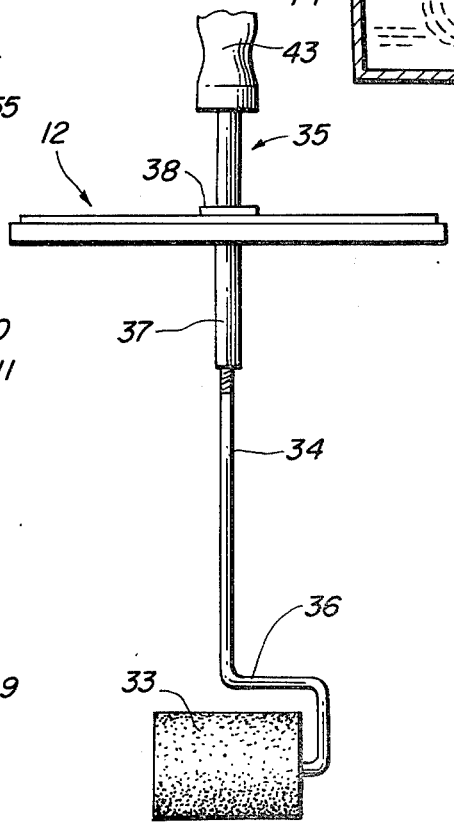

FIG. 7 is a view similar to FIG. 6 but showing the parts of the container in the positions they would occupy as the roller of the associated paint applicator is being withdrawn from the container and paint is being wiped therefrom; and FIG. 8 is a front elevational view of the roller-type paint applicator utilized with the container of the present invention and showing the relative position of the cover of the container on the applicator when the latter is in use.

Briefly described, the present invention contemplates a novel container for receiving a quantity of paint and for internally storing at least the roller of a roller-type paint applicator when the latter is not in use. A pair of vertically extending, plate-like members are supported in spaced relation in the receptacle portion of the container by elongated mounting members, which extend horizontally through openings in the side walls of the receptacle and in the upper ends of the plate-like members. A plurality of springs interconnect and bias the plate-like members toward each other and into engagement with the roller of the applicator with sufficient force to support the roller of the applicator in an elevated position above the level of the paint in the container when the applicator is not in use. The plate-like members also serve to wipe excess paint from the roller as the latter is shifted between the plate-like members. The frame of the applicator extends through an opening in the cover of the container, which also serves to support the applicator in the container and to close the open end of the receptacle when the applicator is not being used.

Figure 1:
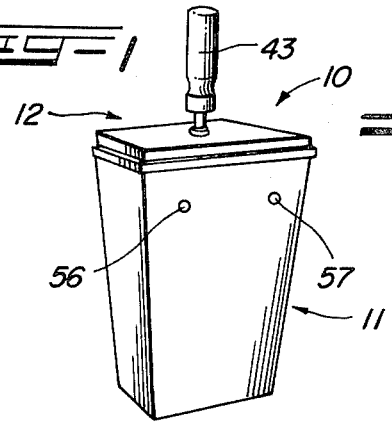
FIG. 1 is a perspective view, on a reduced scale, of a container for receiving a quantity of paint and internally storing the roller of a roller-type paint applicator as the assembly would appear when not in use.
Figure 5:
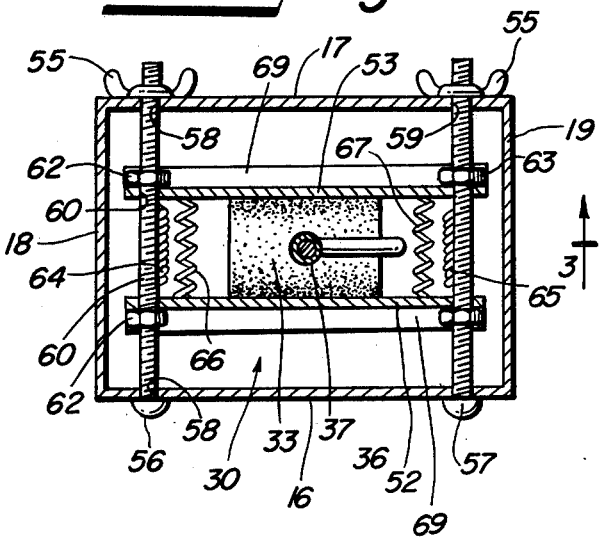
FIG. 5 is a horizontal sectional view taken substantially along the line 5—5 of FIG. 3.
Figure 2:
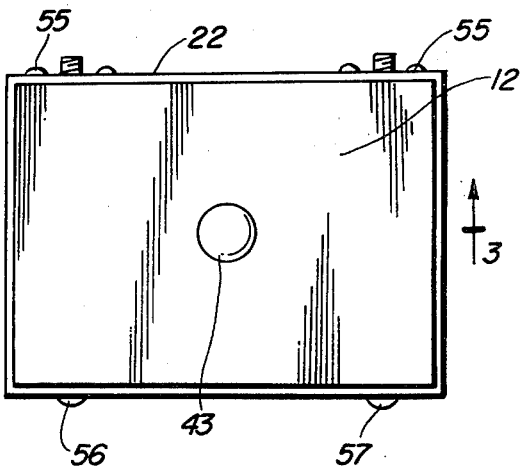
FIG. 2 is a top plan view of the container illustrated in FIG. 1.

Referring now to FIG. 1 a container, indicated generally at 10 and embodying the features of the present invention, is illustrated. The container 10, in the present instance, includes a receptacle portion 11 and a cover 12. The receptacle portion 11 includes a bottom wall 13 and upstanding side wall means which, in the present instance, includes four wall portions 16, 17, 18 and 19. The side wall portions 16, 17 and 18, 19 are parallel, and the wall portions 16 and 17 are longer than the wall portions 18 and 19 so that the receptacle 11 is oblong in cross section, as seen in FIGS. 2 and 5.

The cover 12 is likewise oblong in plan and includes a depending flange 22 which overlaps the upper edges, indicated at 23, of the side walls 16–19, inclusive, to provide a substantially airtight seal when the cover 12 is engaged with the receptacle portion 11.

It will be understood that the receptacle portion 11 and cover 12 of the container 10 could be of a different cross section than oblong, such as square or circular, so long as the interior of the container is large enough to accommodate the roller, indicated at 33, and a portion of the supporting frame, indicated at 34, of an associated roller-type paint applicator, indicated generally at 35.

According to the present invention, support and wiping means, indicated generally at 30, is mounted in the receptacle portion 11 of the container 10. The support and wiping means 30 is adapted to engage the roller 33 of the paint applicator 35 so as to support the applicator in the receptacle portion 11 and to wipe excess paint from the roller whenever the roller is shifted relative to the support and wiping means 30, such as when the applicator 33 is being withdrawn from the receptacle portion 11 for a painting operation.

Figure 3:
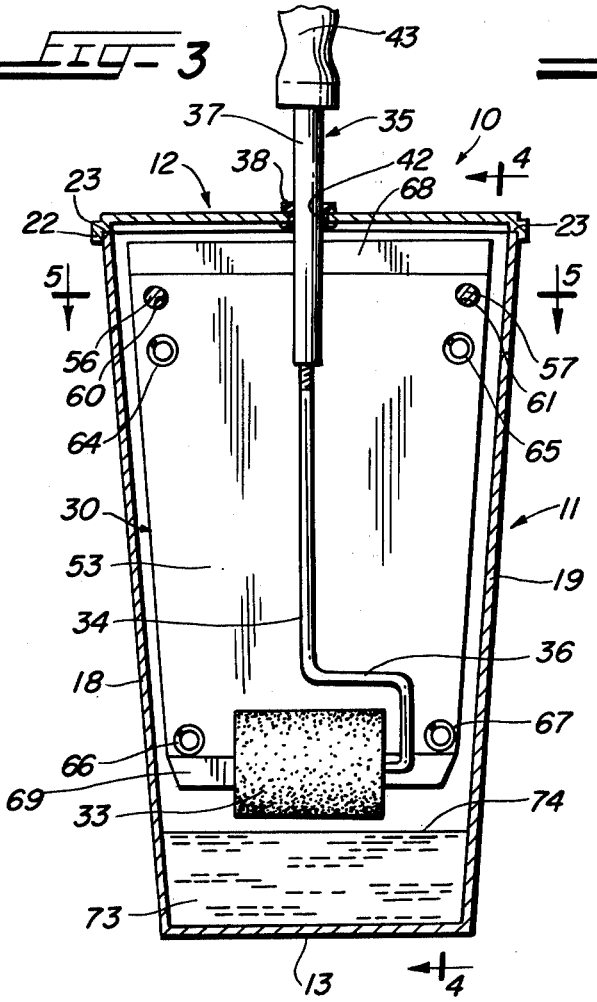
FIG. 3 is a longitudinal sectional view, with some parts in elevation, taken along the line 3—3 of FIG. 2.

As best seen in FIGS. 3 and 8, one end, indicated at 36, of the applicator frame 34 is generally U-shaped and extends to the frame 34. One leg of the U-shaped end 36 provides an axle for rotatably supporting the roller 33, in a conventional manner. In the present instance, an extension 37 is threaded onto the upper end of the frame 34, the extension 37 extending through an elastromeric grommet 38 disposed in an opening 42 in the cover 12. A handle 43 is connected to the upper end of the extension 37.

The support and wiping means 30 comprises at least one and preferably a pair of generally rectangularly-shaped plate-like members 52 and 53 which are mounted in the receptacle portion 11 of the container 10 by mounting means comprising at least one and preferably a pair of elongated mounting members in the form of a pair of bolts 56 and 57. The bolts 56 and 57 extend horizontally through laterally spaced openings 58 and 59 in the side walls 16 and 17 of the receptacle portion 11 and through aligned openings 60 and 61 (FIGS. 3 and 5) in the upper ends of the plate-like members 52 and 53. The openings 60 and 61 are somewhat larger than the diameter of the bolts 56 and 57 so that the members 52 and 53 are shiftable thereon without binding. Stop nuts 62 and 63 are threaded onto the bolts 56 and 57, respectively, to locate the plates 52 and 53 in the receptacle 11 and wing nuts 55, or the like, are threaded onto the outer ends of the bolts 56 and 57 to secure the support and wiping means 30 in the receptacle portion 11.

The plate-like members 52 and 53 are yieldably urged toward each other by biasing means in the form of at least one and preferably two pairs of coil springs 64,65 and 66,67, the pair 64, 65 being disposed toward the upper ends, indicated at 68, of the plate-like members 52 and 53 and the springs 66, 67 being disposed toward the lower ends, indicated at 69, of the members 52 and 53, as illustrated in FIG. 3.

The pairs of springs 64,65 and 66,67 may be connected to the plate-like members 52 and 53 in any desired manner. However, in the illustrated construction, the ends of the springs 64,65 and 66,67 are formed into hooks 72 and 73, respectively, which extend through openings (not shown) in the members 52 and 53 and thus secure the springs to the plate members. The springs 64,65 and 66,67, as well as the bolts 56 and 57, are laterally spaced from each other sufficiently to permit the roller 33 and end 36 of the applicator frame 34 to pass freely therebetween.

The paint applicator storage container 10 operates as follows:

Assuming that the support and wiping means 30 has been mounted in the interior of the receptacle portion 11 by inserting the bolts 56 and 57 through the openings 58 and 59 in the walls 16 and 17 of the receptacle portion 11 and also through the openings 60 and 61 in the upper ends of the plate members 52 and 53, further assuming that the stop nuts 63 have been threaded onto the bolts 56 and 57, and further assuming that the wing nuts 55 have been drawn up, the container 10 is ready for use. Initially, the receptacle portion 11 is partially filled with a quantity of paint, indicated at 73. While varying amounts of paint can be poured into the receptacle portion 11 it is preferable that the level of the paint, indicated at 74, is maintained below the lower ends 69 of the plate-like members 52 and 53.

Figure 4:
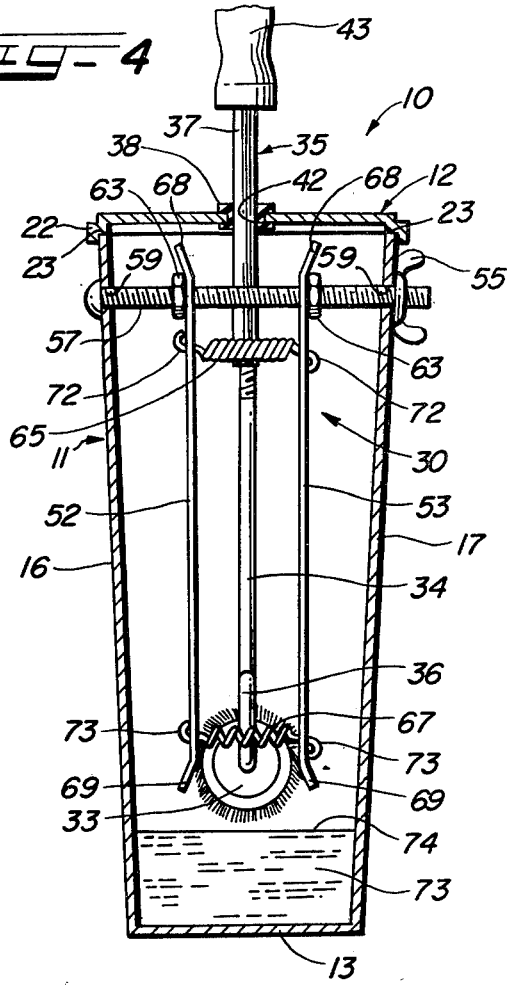
FIG. 4 is a sectional view taken substantially along the line 4—4 of FIG. 3.

After the desired amount of paint has been added to the receptacle portion 11, the roller 33 of the roll-type applicator 32 is inserted between the upper ends 68 of the members 52 and 53 and shifted downwardly to the position thereof illustrated in FIGS. 3 and 4. To this end, the upper ends 68 are preferably inclined away from each other, as illustrated in FIGS. 4, 6 and 7. The outwardly inclined ends 68 thus define a divergent entrance to the space between the plate-like members 52 and 53.

The collapsed length of the springs 64,65 and 66,67 is such that, when the springs are not under tension, the space between the opposed surfaces of the plate-like members 52 and 53 is somewhat less than the diameter of the roller 33. Consequently, as the roller 33 of the applicator 32 is shifted downwardly between the bolts 56 and 57 and pairs of springs 64,65 and 66,67, the springs are placed in tension and the plate-like members 52 and 53 exert a wiping action on the roller. Any residual paint in the roller 33 is thus distributed uniformly in the roller as it moves downwardly between the plates or is wiped therefrom.

If a user of the applicator 32 has completed a painting operation, downward movement of the roller 33 is terminated above the level, indicated at 74, of the paint 73 and the roller 33 remains supported above the level of the paint by the pressure of the springs 64,65 and 66,67 acting through the plate-like members 52 and 53. The storage position of the applicator 35 in the receptacle portion 11 is illustrated in FIG. 4. At this time, the cover 12 is engaged with the upper edges 23 of the receptacle portion 11 and closes the open end of the receptacle portion. The grommet 38 also serves to support the applicator 35 in an upright position in the container 10.

Subsequently, if the need arises to paint an object, the user grasps the handle 43 of the applicator 35 and applies sufficient downward force thereto to cause the roller 33 to become immersed in the paint 73 in the bottom of the receptacle portion 11, as illustrated in FIG. 6. He then pulls upwardly on the handle 43 with sufficient force to shift the roller 33 upwardly between the plate-like members 52 and 53 as the applicator 32 is withdrawn from the receptacle portion 11. Movement of the roller 33 from its immersed position illustrated in FIG. 6 to its engaged position between the members 52 and 53 is facilitated by the outwardly inclined lower ends 69 of the plate-like members 52 and 53. The outwardly inclined lower ends 69 thus define another divergent entrance to the space between the plate-like members.

As the applicator 32 is pulled upwardly between the plate-like members 52 and 53, excess paint is wiped from the roller 33 and returned to the bottom of the receptacle portion 11 by gravity. Consequently, after the applicator 32 is completely withdrawn from the receptacle portion 11, the roller 33 is ready for use with the proper quantity of paint evenly distributed therethrough such as to minimize any possibility of runs or drips. The cover 12 remains on the extension 37 of the applicator when the latter is in use.

Since the support and wiping means 30 is mounted in the receptacle portion 11 by the bolts 56 and 57 and wing nuts 55, it is easily removable for cleaning, inspection and/or replacement.

While only one embodiment of the invention has been herein illustrated and described, it will be understood that modifications, variations and equivalents thereof may be effected without departing from the spirit of the invention and which fall within the scope of the appended claims.

I claim:

1. A container for receiving a quantity of paint and for storing a roller-type paint applicator therein so that the applicator is at all times ready for use, said container comprising a receptacle portion having a bottom wall, upstanding side wall means, and an open upper end, said receptacle portion being adapted to receive a quantity of paint, a removable cover for closing the open end of said receptacle portion, and combined support and wiping means in said receptacle portion for engaging the roller of a roller-type paint applicator and holding said roller in a fixed position above the level of the paint in said receptacle portion, said support and wiping means also being operable to wipe excess paint from the roller of said applicator as the latter is shifted while the roller is engaged with said support and wiping means, the cover of said container preventing paint is said receptacle portion and in the roller of said applicator from hardening when said applicator is positioned in said receptacle portion and said cover is engaged with the open end of said receptacle portion.

2. The container of claim 1, in which said support and wiping means comprises at least one substantially vertically extending plate-like member and means for biasing the roller of said applicator into engagement with a surface of said plate-like member, said biasing means exerting sufficient force on the roller of said applicator to prevent said applicator from shifting in said receptacle portion due to the force of gravity and to wipe excess paint therefrom as said roller moves across said surface.

3. The container of claim 2, in which said support and wiping means comprises a pair of said plate-like members arranged in generally parallel, spaced relation, and said biasing means comprises at least one pair of springs connected to said plate-like members.

4. The container of claim 3, in which said plate-like members have upper and lower ends, and said upper and lower ends are inclined away from each other to define divergent entrances to the space between said plate-like members.

5. The container of claim 3, in which said applicator has an elongated support frame having a paint roller rotatably mounted at one end thereof, the springs of said one pair extend between and are connected to said plate-like members, and the springs of said one pair also being laterally spaced from each other by an amount sufficient to permit the roller and supporting frame of said applicator to pass therebetween.

6. The container of claim 5, in which said plate-like members have upper and lower ends, another pair of springs extend between and are connected to said plate-like members, the springs of said one pair being disposed toward the upper ends of said plate-like members, the springs of said other pair being disposed toward the lower ends of said plate-like members, and the lateral spacing between the springs of each pair being such that the roller and supporting frame of said applicator may pass freely therebetween.

7. The container of claim 6, in which the springs of each pair are coil springs, and the collapsed length of the coil springs of at least one of said pairs is such that space between the opposed surfaces of said plate-like members is somewhat less than the diameter of the roller of said applicator.

8. The container of claim 3, in which the length of said plate-like members is less than the height of said receptacle portion, and mounting means is provided for mounting said plate-like members in the upper portion of said receptacle portion.

9. The container of claim 8, in which said mounting means comprises at least one elongated mounting member extending horizontally through openings in the side wall means of said receptacle portion and through openings in said plate-like members.

10. The container of claim 9, in which a pair of said elongated mounting members are provided for mounting said plate-like members in said receptacle portion, said mounting members being laterally spaced from each other by an amount sufficient to permit the roller and supporting frame of said applicator to pass freely therebetween.

11. The container of claim 1, in which said support and wiping means is carried by said upstanding side wall means.

* * * * *